US010443820B2

(12) United States Patent
Peter et al.

(10) Patent No.: US 10,443,820 B2
(45) Date of Patent: Oct. 15, 2019

(54) PLASTIC LED FIXTURE HOUSING WITH OUTER FRAME

(71) Applicant: General Electric Company, Schenectady, NY (US)

(72) Inventors: Akos Peter, Budapest (HU); Krisztian Novak, Budapest (HU)

(73) Assignee: CURRENT LIGHTING SOLUTIONS, LLC, East Cleveland, OH (US)

( * ) Notice: Subject to any disclaimer, the term of this patent is extended or adjusted under 35 U.S.C. 154(b) by 125 days.

(21) Appl. No.: 14/934,305

(22) Filed: Nov. 6, 2015

(65) Prior Publication Data

US 2016/0161093 A1 Jun. 9, 2016

Related U.S. Application Data

(60) Provisional application No. 62/089,375, filed on Dec. 9, 2014.

(51) Int. Cl.

| | |
|---|---|
| ***F21V 15/01*** | (2006.01) |
| ***F21V 21/00*** | (2006.01) |
| ***F21V 31/03*** | (2006.01) |
| ***F21S 8/08*** | (2006.01) |
| ***F21V 5/00*** | (2018.01) |
| ***F21V 21/116*** | (2006.01) |
| *F21W 131/10* | (2006.01) |
| *F21W 131/103* | (2006.01) |

(Continued)

(52) U.S. Cl.

CPC ..... *F21V 15/01* (2013.01); *F21S 8/086* (2013.01); *F21V 5/007* (2013.01); *F21V 21/00* (2013.01); *F21V 21/116* (2013.01); *F21V 31/03* (2013.01); *F21W 2131/10* (2013.01); *F21W 2131/103* (2013.01); *F21Y 2101/00* (2013.01); *F21Y 2105/10* (2016.08); *F21Y 2115/10* (2016.08)

(58) Field of Classification Search

CPC .... F21W 2131/103; F21S 6/005; F21S 6/006; F21S 8/032; F21V 15/01; F21V 21/00; F21V 21/02; F21V 21/108; F21V 21/116

See application file for complete search history.

(56) References Cited

U.S. PATENT DOCUMENTS

| | | | | |
|---|---|---|---|---|
| 2,357,105 A | | 8/1944 | Grinnell | |
| 4,369,429 A | * | 1/1983 | Souder | G08G 1/095 220/3.9 |

(Continued)

FOREIGN PATENT DOCUMENTS

| | | | |
|---|---|---|---|
| CN | 101769515 | A | 7/2010 |
| CN | 201568791 | U | 9/2010 |

(Continued)

OTHER PUBLICATIONS

PCT Search Report and Written Opinion issued in connection with Related Application No. PCT/US2015/046481 dated Jan. 26, 2016.

(Continued)

*Primary Examiner* — Ismael Negron

(74) *Attorney, Agent, or Firm* — Buckley, Maschoff & Talwalkar, LLC; Peter T. DiMauro

(57) ABSTRACT

An apparatus including a polymeric housing to enclose electrical and optical components of a lighting fixture; and an outer frame affixed to the housing, the outer frame including a coupler to mechanically attach the apparatus to another device.

10 Claims, 3 Drawing Sheets

(51) Int. Cl.

| | |
|---|---|
| *F21Y 105/10* | (2016.01) |
| *F21Y 115/10* | (2016.01) |
| *F21Y 101/00* | (2016.01) |

(56) References Cited

U.S. PATENT DOCUMENTS

| | | | | |
|---|---|---|---|---|
| 4,435,983 | A | 3/1984 | Shimano | |
| 4,890,947 | A | 1/1990 | Williams et al. | |
| 6,527,422 | B1 * | 3/2003 | Hutchison | F21V 29/505 362/290 |
| 6,736,543 | B2 | 5/2004 | Couturet | |
| 6,910,795 | B2 | 6/2005 | Luca et al. | |
| 7,160,140 | B1 | 1/2007 | Mrakovich et al. | |
| 7,329,030 | B1 * | 2/2008 | Wang | F21V 29/004 165/104.11 |
| 7,452,737 | B2 | 11/2008 | Basin et al. | |
| 7,633,055 | B2 | 12/2009 | Nall et al. | |
| 7,766,509 | B1 | 8/2010 | Laporte | |
| 7,850,341 | B2 * | 12/2010 | Mrakovich | G02B 6/001 362/235 |
| 7,915,061 | B2 | 3/2011 | Nall et al. | |
| 7,931,386 | B2 | 4/2011 | Nall et al. | |
| 8,232,745 | B2 | 7/2012 | Chemel et al. | |
| 8,342,733 | B2 | 1/2013 | Daily et al. | |
| 8,348,461 | B2 | 1/2013 | Wilcox et al. | |
| 8,410,726 | B2 | 4/2013 | Dau et al. | |
| 8,543,249 | B2 | 9/2013 | Chemel et al. | |
| 8,636,385 | B2 | 1/2014 | Fabbri et al. | |
| 8,712,324 | B2 | 4/2014 | Corbridge et al. | |
| 8,729,826 | B2 | 5/2014 | Jonsson | |
| 8,756,801 | B2 | 6/2014 | Nall et al. | |
| 8,764,240 | B2 | 7/2014 | Veenstra et al. | |
| 8,766,487 | B2 | 7/2014 | Dibben et al. | |
| 8,950,907 | B2 * | 2/2015 | Packard | F21V 19/04 362/227 |
| 9,210,773 | B1 * | 12/2015 | Sargent | F21V 15/01 |
| 9,546,776 | B2 * | 1/2017 | Kuti | F21V 15/01 |
| 9,605,821 | B2 * | 3/2017 | Al-Gaadi | H05K 1/0209 |
| 9,605,822 | B2 * | 3/2017 | Yang | F21S 9/037 |
| 2010/0029268 | A1 | 2/2010 | Myer et al. | |
| 2010/0259931 | A1 | 10/2010 | Chemel et al. | |
| 2011/0068672 | A1 | 3/2011 | Hasnain | |
| 2011/0075433 | A1 | 3/2011 | Mart et al. | |
| 2011/0305056 | A1 * | 12/2011 | Chien | F21S 8/035 363/178 |
| 2012/0008329 | A1 * | 1/2012 | Wang | F21V 15/01 362/372 |
| 2012/0120653 | A1 * | 5/2012 | Peck | F21S 8/06 362/235 |
| 2012/0250311 | A1 | 10/2012 | Luegge | |
| 2012/0281404 | A1 | 11/2012 | Wilcox et al. | |
| 2014/0016298 | A1 | 1/2014 | Lind et al. | |
| 2014/0132206 | A1 | 5/2014 | Zhu | |
| 2014/0159502 | A1 | 6/2014 | Shimokawa et al. | |
| 2014/0174822 | A1 | 6/2014 | Corona | |
| 2014/0175690 | A1 | 6/2014 | Sudermann | |
| 2014/0177139 | A1 | 6/2014 | Kari | |
| 2014/0226331 | A1 | 8/2014 | Kinnune et al. | |
| 2016/0327237 | A1 * | 11/2016 | Hoch | F21V 5/04 |

FOREIGN PATENT DOCUMENTS

| | | | |
|---|---|---|---|
| CN | 102080805 | A | 6/2011 |
| CN | 201944679 | U | 8/2011 |
| CN | 203023940 | U | 6/2013 |
| CN | 203940400 | U | 11/2014 |
| DE | 2159971 | A1 | 6/1973 |
| DE | 4235864 | A1 | 4/1994 |
| DE | 30208133 | T2 | 8/2006 |
| DE | 102010044675 | A1 | 3/2012 |
| EP | 2058584 | A1 | 5/2009 |
| EP | 2690357 | A1 | 1/2014 |
| JP | 2004303614 | A | 10/2004 |
| JP | 2005116182 | A | 4/2005 |
| WO | 0165124 | A1 | 9/2001 |
| WO | 2008031275 | A1 | 3/2008 |
| WO | 2011050256 | A1 | 4/2011 |
| WO | 2011057343 | A1 | 5/2011 |
| WO | 2013020415 | A1 | 2/2013 |
| WO | 2013159833 | A1 | 10/2013 |
| WO | 2014052897 | A1 | 4/2014 |

OTHER PUBLICATIONS

PCT Search Report and Written Opinion issued in connection with corresponding Application No. PCT/US2015/060848 dated Jan. 29, 2016.

First office action and Search issued in connection with corresponding CN Application No. 201580067364.4 dated Oct. 9, 2018 (Machine translation not available), 12 pages.

* cited by examiner

PLASTIC LED FIXTURE HOUSING WITH OUTER FRAME

Outdoor lighting fixtures having parts thereof constructed of a plastic material are known to be lightweight and manufactured efficiently and inexpensively. However, outdoor lighting fixtures are desired that can withstand the rigors of being located outdoors, including but not limited to repeated loads placed thereupon by wind and other environmental hazards.

A known point of failure or at least weakness of some outdoor lighting fixtures is a connection point between the lighting fixture and a mounting device or system. For example, a lighting fixture may be prone to fatigue or failure at a connection point between the lighting fixture and a light pole to which the fixture is attached.

Therefore, it would be desirable to design an outdoor lighting fixture that is durable, lightweight, and structurally robust.

SUMMARY

According to some embodiments, an apparatus is provided including a polymeric housing to enclose electrical and optical components of a lighting fixture; and an outer frame affixed to the housing, the outer frame including a coupler to mechanically attach the apparatus to another device. Other embodiments are associated with a process of manufacturing the lighting apparatus or systems described herein.

A technical effect of some embodiments of the present disclosure is an efficient lighting fixture and technique for producing a lighting system including an outer frame and a polymeric housing, in some embodiments. With this and other advantages and features that will become hereinafter apparent, a more complete understanding of the nature of the invention can be obtained by referring to the following detailed description and to the drawings appended hereto.

DETAILED DESCRIPTION

Figure 1:
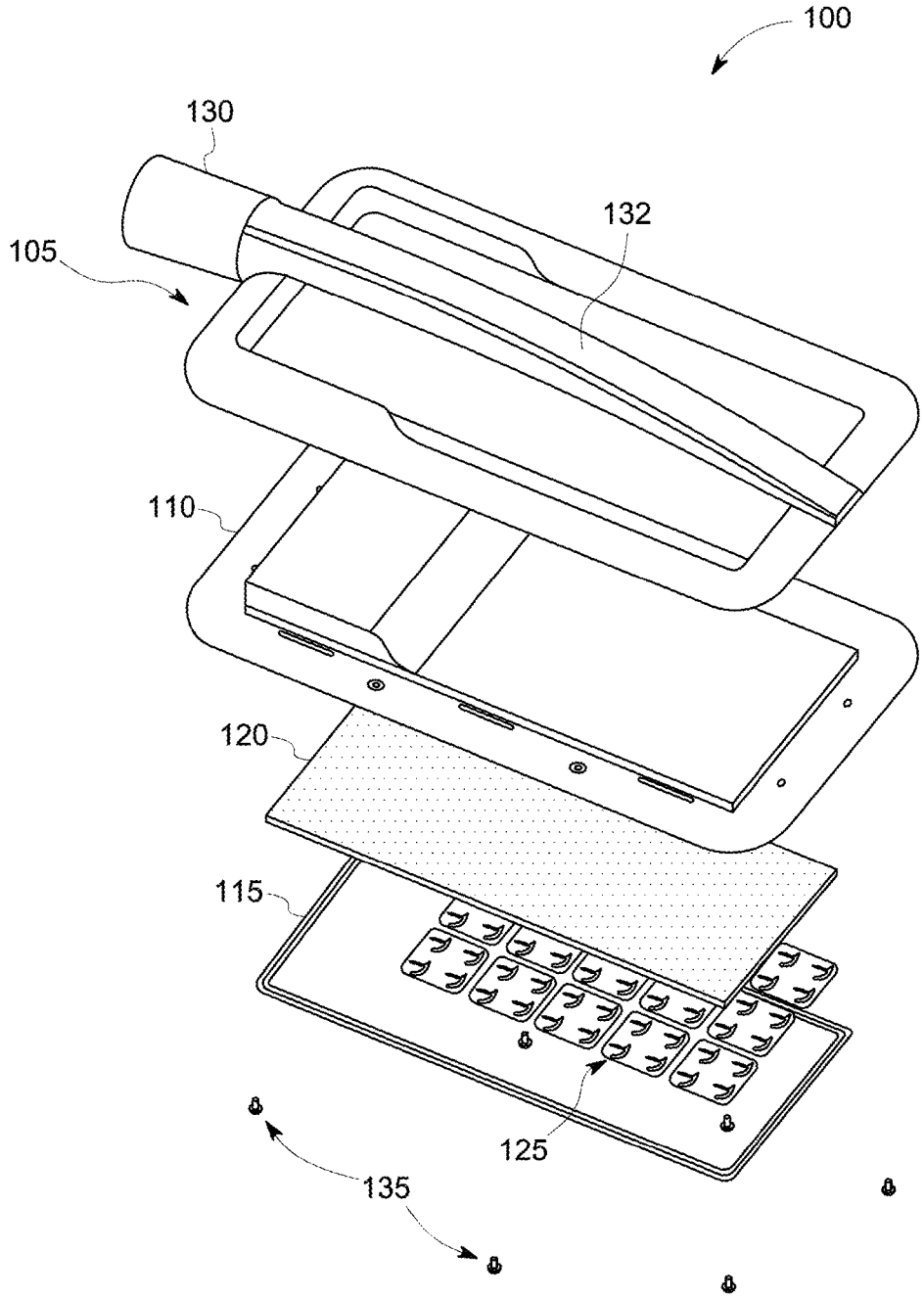
FIG. 1 is an illustrative depiction of a lighting fixture, according to some embodiments.

FIG. 1 is an illustrative depiction of a lighting fixture 100, in accordance with some embodiments herein. In general, lighting fixture 100 is an outdoor lighting fixture enclosed in a polymeric housing with an outer frame. Referring to FIG. 1, specific aspects of a lighting fixture in accordance with embodiments of the present disclosure are shown. Lighting fixture 100 includes an outer frame 105. Outer frame 105 may provide mechanical strength and integrity to lighting fixture 100. In some embodiments, lighting fixture 100 may be constructed of a metal (e.g., aluminum, stainless steel, copper, etc.), a metal alloy, a composite material (e.g., a carbon fiber, a fiberglass, etc.), and other materials. Lighting fixture 100 also includes a plastic housing for enclosing the electrical, electronic, and optical components of the lighting fixture. The housing of lighting fixture 100 may comprise two distinct parts, an upper housing 110 and a cover plate

115. Upper housing, in some embodiments, may include a planar surface and an integrated sidewall along a periphery of the planar surface, where the sidewalls provide a sufficient amount of depth to receive other components of the lighting fixture when mated with the opposing cover plate 115. In some embodiments, cover plate 115 may not include a peripheral sidewall, as shown in FIG. 1. In some other embodiments, cover plate 115 may include a peripheral sidewall that matingly cooperates with upper housing 110 that may or may not include a peripheral sidewall itself, to provide a cavity for housing other components of the lighting fixture therein.

As shown in FIG. 1, lighting fixture 100 further includes a printed circuit board (PCB) layer 120 (or simply PCB 120). Printed circuit board 120 may support electrical and electronic components such as, for example, one or more solid state light sources including but not limited to light emitting diodes (LEDs), a driver circuit to regulate power to the solid state light source(s), electrical connectors, and other electrical components. Lighting fixture 100 may also include one or more optical components 125 such as, for example, a lens, a reflector, a filter, and other optical components. In some embodiments, the optical components may be distinct and separate from other components or integrated with at least some other components. Optical component 125 (shown as a lens) of lighting fixture 100 is affixed or joined to PCB 120. In some embodiments, optical component 125 may include a plurality of lensing or other optical elements that correspond to one or more, not necessarily equal, number of light sources (e.g. LEDs) on PCB 120.

In an assembled configuration, the components including PCB 120 and optical components 125 are disposed in a cavity formed within the housing comprising upper housing 110 and cover plate 115. The upper housing 110 and cover plate 115 can be joined together by one or more techniques for joining plastic components including, for example, hot staking, vibration welding, ultrasonic welding, gluing, and other technologies.

Outer frame 105 matingly fits on top of upper housing 110 to provide structural strength and integrity to the lighting fixture. Outer frame 105 includes a coupler 130 to attach, connect, and interface with another device such as a mounting base or pole (not shown in FIG. 1). In some aspects, coupler 130 may provide a mechanism to physically couple or attach lighting fixture 100 to another device.

In some embodiments, coupler 130 has a distal open end that may receive a rod or dowel-like component of another device to which lighting fixture 100 can be removably attached. In some embodiments, outer frame 105 may include a central spine 132 bridging and connecting opposing sides of outer frame 105. Although depicted as a single piece in FIG. 1, central spine 132 may comprise more than one physical feature and in some embodiments may bridge opposing sides of outer frame 105 in a lengthwise (as shown), a widthwise, and combinations thereof fashion. Central spine 132 may act to add additional rigidity and structural integrity to outer frame 105.

In some aspects, the polymeric housing enclosing the electrical and optical components of the lighting fixture herein provides a lightweight and weatherproof enclosure that can be manufactured efficiently and relatively inexpensively, whereas the outer frame provides a strong and durable component that can further protect the plastic housing from environmental hazards and provide a structurally sound mounting interface with other devices and systems. The outer frame 105 may provide sufficient mechanical strength for the whole structure 100 to meet outdoor fixture standard requirements while the plastic housing attached to the frame has desired electrical insulation characteristics and can be easily manufactured. In combination, benefits of lighting fixture 100 include a lightweight main housing that is easily manufactured and a metal frame having a robust coupler to mechanically mount and interface the lighting fixture to other devices.

In some embodiments, outer frame 105 may provide a structurally strong mechanism for electrical and mechanically connections and interfaces with other components. Outer frame 105 may provide a structurally sound interface to, for example, a light pole to support and position the lighting fixture in a desired location and orientation (e.g., over a roadway). Additionally, outer frame 105 may provide or facilitate an electrical connection with a source of power, control, and other communication signals. Outer frame 105 may be constructed of a metal, a metallic alloy, a composite material, and/or combinations thereof.

In some embodiments, a polymeric part may be injection-molded above or around (i.e., overmolded over) the several layers of lighting fixture or luminaire 100. As referred to herein, the several layers may refer to an optics layer (including optical component(s) 125), the LED and PCB layer 120, and other electrical and optical components including, but not limited to, a heat sink or other heat management component (not shown). Accordingly, the particular components housed within a housing of lighting fixture 100 and the specific construction thereof may vary to the extent that such changes do not conflict with other aspects herein, including a plastic housing that is attached to an outer frame having a coupler.

In some embodiments, coupler 130 may include a variety of mechanical and electrical couplers and plugs attached to and/or integrated therewith, including those now known and those that become known.

In some embodiments, optical component 125 may include a flat optical sheet configured for outdoor LED lighting. The flat optical sheet may be comprised of, for example, polycarbonate or glass lenses to distribute light emitted from LED or other light sources in desired pattern(s) and direction(s). In certain embodiments, a plurality of lenses may be arranged in a matrix disposed and fixed in locations with another material where the matrix of lenses may correspond to a plurality of LED's on PCB 120. In some aspects, the optical sheet comprising optical component 125 may have certain (i.e., desired) optical properties in limited areas of the sheet. For many outdoor lighting fixtures, it may be important to have a flat light emitting surface in order to maintain the "Upper Light Output Ratio" (ULOR) at about zero, and to avoid contamination of the light sources. In some embodiments, the present aspect of the disclosure provides a flat optical sheet that distributes the light emitted by a matrix of LEDs to produce an ideal light distribution shape for street lighting that may be suitably employed with other aspects of this disclosure. The optical component comprising the optical sheet may be constructed of one or more optical materials, such as polycarbonate, PMMA (poly methylmethacrylate), PC (polycarbonate), glass, and/or the like. Light may be guided or directed through an optical pathway from a surface of the solid state (e.g., LED) light source to an environment outside of the housing by one or more total internal reflections (TIR). Unlike some traditional reflectors that may reflect the light coming from a light source, TIR lenses have no internal losses. The surface of the optical sheet where the light leaves the optical material may be flat or has without sharp edges. The optical sheet can be made from one molded part, several overmolded parts, several glued parts, or parts that are otherwise attached together in order to obtain the desired light distribution shape. The surface where the light (produced by, for example, LED or other solid state light source chip or chips) enters into the sheet can be textured, flat, or curved. In some embodiments, the optical sheet may contain reflective particles or elements. In some aspects, there may be inner obstructions provided to avoid a glare effect of the lighting fixture. Reflective particles may be inserted by overmolding, painting, gluing or any other way. The flat optical sheet may be mounted on the luminaire or lighting fixture housing, possibly using gaskets to provide a seal around the optical component 125.

In some embodiments, lighting fixture 100 may include a driver circuit or component that may be provided in module located outside of the housing of the lighting fixture. Such driver may be placed, in part or in whole, in a connector unit outside the lighting fixture. In some embodiments and contexts, one may employ a module or modular unit that contains a driver for the solid state (e.g., LED) light sources and connects a pole or other mount and the lighting fixture together. Therefore, in some embodiments herein, lighting fixture 100 may not contain a LED driver within the housing of the lighting fixture. This modular connector unit can connect the pole arm and the lighting fixture, may be placed between the pole and the pole arm, or another location. It may be advantageous to place the driver in the described locations outside of the housing since the driver may sometimes suffer from overheating more easily than a LED module. Also, some drivers in proximity with LED modules inside of fixtures may sometimes heat each other, thereby promoting a possible failure. In some alternative embodiments, the driver may be integrated into a pole, pole arm, or other mounting device or base. Furthermore, the driver module may have mechanical advantages to its placement in that it may be configured to assist in a positioning of the housing or luminaire.

In some embodiments, coupler 130 may interface or mate with a dowel-like mounting for connecting a lighting fixture herein to a pole or other lighting fixture base, mount, or extension. In some embodiments, this coupler provides a solution for mounting a lighting fixture or luminaire herein to a pole comprising, for example, a street lamp. The structure to which a lighting fixture herein may be attached or connected to may have an outward appearance similar to a dowel or rod-shaped member.

In some embodiments, coupler 130 may include an adjustable coupler that may be optionally placed between the lighting fixture or luminaire and a mounting device or base discussed above. An adjustable coupler herein may be composed of a plurality of (e.g., four) toothed, annular pieces that permit the luminaire to be adjusted to a selected angle or position.

In some aspects, some of the improvements of the present disclosure include, but are not limited to, an aluminum, metallic, or composite material outer frame to enhance the mechanical strength of the luminaire structure. Although not wishing to be limited by theory, it is believed that the outer frame enhances the wind-force resistance. Such wind force resistance and device robustness is highly important for validating a lighting fixture for outdoor use.

Figure 2:
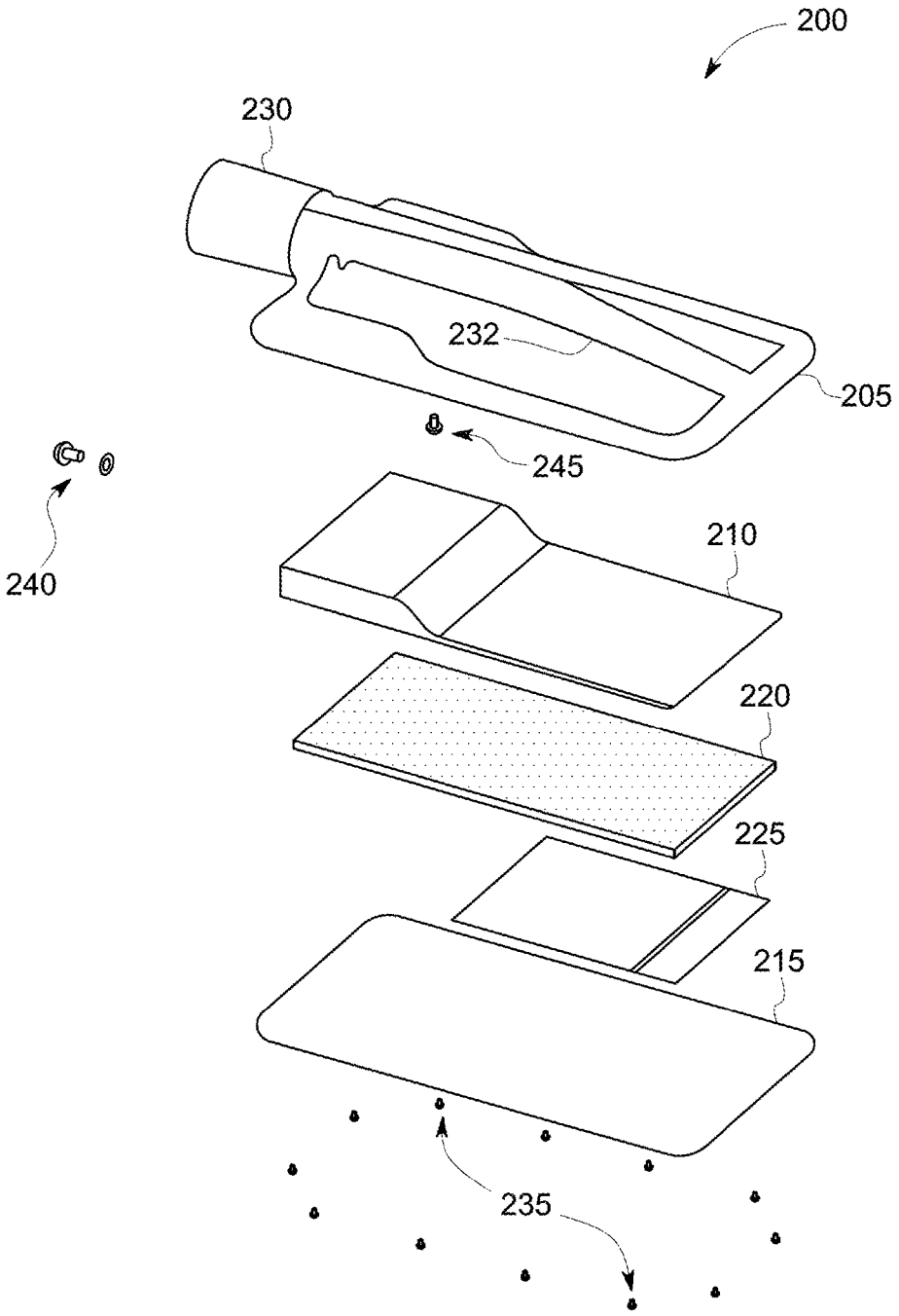
FIG. 2 is an illustrative depiction of a lighting fixture, including components to manufacture the lighting fixture, according to some embodiments herein.

FIG. 2 is an illustrative depiction of a lighting fixture 200, in accordance with some embodiments herein. In large part, the constituent components of lighting fixture 200 may be similar to or the same as the lighting fixture discussed with regards to FIG. 1. As such, a full understanding of many aspects of lighting fixture 200 may be had by one skilled in the area(s) related hereto upon a reading of the discussion of lighting fixture 100 hereinabove and will not be repeated below. FIG. 2 will be referred to in conjunction with a discussion of FIG. 3 regarding a process to manufacture lighting fixture 200.

The lighting fixture 200 shown in FIG. 2 includes an outer frame 205 that is matingly fitted to a housing comprising upper housing 210 and front cover 215. In some embodiments, outer frame 205 includes a coupler 230, a central spine 232, and is affixed to the housing of lighting fixture 200 by screws or fasteners 235. In some embodiments, other mechanisms for attaching outer frame 205 to the housing of the lighting fixture may be used, alone or in combination, with screws 235 and other alternative fastening processes and techniques such as, for example, welding, gluing using adhesives, etc. Housed or otherwise contained within the housing are PCB 220 that supports one or more light sources and other electrical component including wire traces and electrical and communication interconnects and optics component 225.

Figure 3:
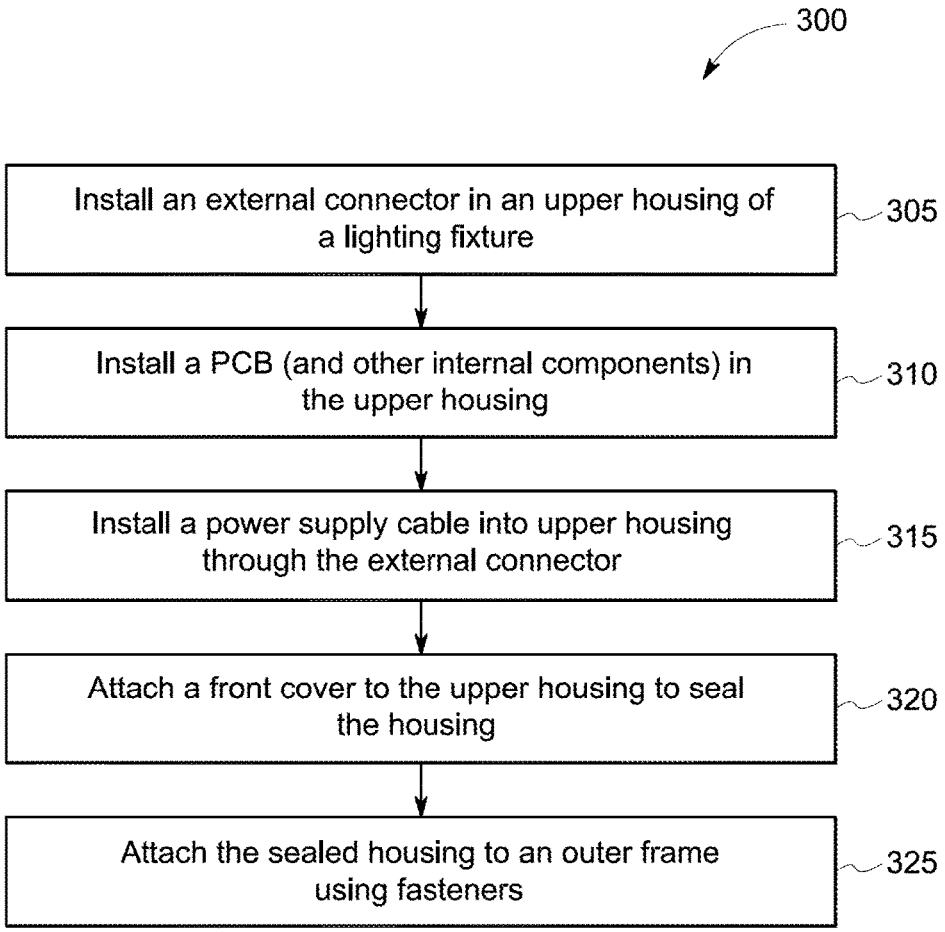
FIG. 3 is an illustrative flow diagram of a process, according to some embodiments herein.

FIG. 3 discloses a process of assembling or manufacturing lighting fixture 200. Process 300 includes a number of operations that may be implemented in some instances in combination with each other and other process or operations. Operation 305 includes installing breather 245 and cable gland 240 into the lighting fixture's upper housing 210. Breather 245 provides a mechanism for moisture, if any, to drain out of the housing after assembly and equalize pressure inside and outside of the sealed compartment. Although the assembled housing may be substantially weatherproof, a small amount of moisture may, from time to time, make its way into the housing. However, breather 245 provides a mechanism to facilitate the draining of such moisture out of the housing. Cable gland 240 may comprise one or more parts (e.g., two in FIG. 2). Features of cable gland 240 may include providing a weather-tight an access port through which cable(s) may be routed into and out of the housing. In some aspects, cable gland 240 may provide a weather-tight seal between the cable(s) and an opening in the upper housing 210, as well as a measure of strain-relief on the cables (not shown in FIG. 2).

Operation 310 includes installing a PCB 220 and other internal components (i.e., electrical, optical, and mechanical components) in upper housing 210. The internal components may be affixed in or to the upper housing 210 using one or more polymeric fastening mechanisms, including but not limited to, hot staking, a retaining washer or Starlock™, and other types of component joining techniques.

At operation 315, a power supply cable (not shown) may be installed into upper housing 210 through cable gland 240 in a "pre-cabling" process. Operation 315 may include terminating the cables fed through cable gland 240 to the appropriate electrical and communication interconnects supported on or by PCB 220.

Process 300 continues at operation 320 where front cover 215 is attached to upper housing 210, to include PCB 220 and optics 225 within a cavity formed by the upper cover and the cover when they are mated to each other. In some aspects, cover 215 may be attached to upper housing 210 by one or more attachment techniques including, but not limited to vibration welding, ultrasonic welding, gluing, etc.

Continuing to operation 325, the housing that is now sealed by virtue of operation 320, may be attached to outer frame by screw fasteners 235. It should be appreciated that other mechanisms for attaching outer frame 205 to the assembled can be used herein other than the screws 235.

In some aspects, the assembled housing comprising upper housing 210 and cover 215 is not intended to be re-opened after the sealing of the housing at operation 320. However, the sealed housing may be selectively removed from outer frame 230. In this manner, the sealed housing including the electrical and optical components of a lighting fixture as disclosed herein may be readily replaced as a unit and the outer frame can be reused with a new or different sealed lighting fixture unit.

Although embodiments have been described with respect to certain contexts, some embodiments may be associated with other types of devices, systems, and configurations, either in part or whole, without any loss of generality.

The embodiments described herein are solely for the purpose of illustration. Those in the art will recognize other embodiments which may be practiced with modifications and alterations. Those in the art will appreciate that various adaptations and modifications of the above-described embodiments can be configured without departing from the scope and spirit of the claims. Therefore, it is to be understood that the claims may be practiced other than as specifically described herein.

What is claimed is:

1. A lighting apparatus comprising:

a polymeric housing enclosing electrical and optical components of a lighting fixture, the polymeric housing comprising a plastic upper housing and a plastic cover plate including a peripheral sidewall that matingly cooperates with the upper housing to provide a cavity for housing the electrical and optical components therein, wherein the optical components comprise a plurality of optical lenses, wherein the plurality of optical lenses comprise at least one optical lens configured to distribute light emitted from a solid state light source in a predetermined pattern; and an outer frame matingly fit on top of the upper housing of the polymeric housing, the outer frame including a coupler to mechanically attach the lighting apparatus to another device, wherein the outer frame is constructed of at least one of metal, a metal alloy, and a composite material, the outer frame further comprising a central spine bridging and connecting opposing sides of the upper housing in a lengthwise fashion.

2. The lighting apparatus of claim 1, wherein the coupler includes an open distal end to receive a mounting device therein.

3. The lighting apparatus of claim 1, wherein the polymeric housing is constructed of at least one of a polycarbonate, PMMA (poly methylmethacrylate), PC (polycarbonate), and combinations thereof.

4. The lighting apparatus of claim 1, wherein the outer frame facilitates an electrical connection with a source of communication signals.

5. The lighting apparatus of claim 1, wherein the electrical components comprise a printed circuit board and the solid state light source.

6. The lighting apparatus of claim 5, wherein the solid state light source includes at least one light emitting diode (LED) supported by the printed circuit board.

7. A lighting fixture comprising:

a circuit board;

a solid state light source supported on the circuit board;

a plurality of optical lenses, wherein the plurality of optical lenses comprise at least one optical lens affixed or joined to the circuit board to distribute light emitted from the solid state light source;

a polymeric housing comprising a plastic upper housing and a plastic cover plate including a peripheral sidewall that matingly cooperates with the upper housing to provide a cavity that encloses the circuit board, the solid state light source, and the plurality of optical lenses, wherein the at least one optical lens is configured to distribute light emitted from the solid state light source within the polymeric housing in a predetermined pattern; and an outer frame matingly fit on top of the upper housing of the polymeric housing, the outer frame being constructed of at least one of metal, a metal alloy, and a composite material, the outer frame further comprising a central spine bridging and connecting opposing sides of the upper housing in a lengthwise fashion.

8. The lighting fixture of claim 7, further comprising a breather in the polymeric housing to facilitate draining of moisture from the polymeric housing.

9. The light fixture of claim 8, wherein the breather further facilitates equalizing a pressure inside and outside of the polymeric housing.

10. A lighting fixture comprising:

a circuit board;

a solid state light source supported on the circuit board;

a plurality of optical lenses, wherein the plurality of optical lenses comprise at least one optical lens affixed or joined to the circuit board to distribute light emitted from the solid state light source;

a polymeric housing comprising a plastic upper housing and a plastic cover plate including a peripheral sidewall that matingly cooperates with the upper housing to provide a cavity that encloses the circuit board, the solid state light source, and the plurality of optical lenses, wherein the at least one optical lens is configured to distribute light emitted from the solid state light source within the polymeric housing in a predetermined pattern; and an outer frame matingly fit on top of the upper housing of the polymeric housing, the outer frame being constructed of at least one of metal, a metal alloy, and a composite material, the outer frame further comprising a central spine bridging and connecting opposing sides of the upper housing in a lengthwise fashion;

wherein the outer frame facilitates an electrical connection with a source of communication signals.

* * * * *